United States Patent [19]

Todd

[11] Patent Number: 4,545,417

[45] Date of Patent: Oct. 8, 1985

[54] WIDE SPAN OVERHEAD DOOR

[76] Inventor: Robert W. Todd, P.O. Box 561, Wilsonville, Oreg. 97070

[21] Appl. No.: 506,023

[22] Filed: Jun. 20, 1983

[51] Int. Cl.[4] ..... E05D 15/26

[52] U.S. Cl. ..... 160/207

[58] Field of Search ..... 160/189, 190, 193, 207, 160/213

[56] References Cited

U.S. PATENT DOCUMENTS

| | | | |
|---|---|---|---|
| 2,203,264 | 6/1940 | Horstman | 160/190 |
| 2,274,216 | 2/1942 | Sanders | 160/190 |
| 2,308,585 | 1/1943 | Bowsher | 160/190 |
| 3,024,838 | 3/1962 | Egleston et al. | 160/193 |
| 3,192,992 | 7/1965 | Hasselmark | 160/207 |
| 4,026,343 | 5/1977 | James | 160/207 |

*Primary Examiner*—Peter M. Caun

*Attorney, Agent, or Firm*—Oliver D. Olson

[57] ABSTRACT

An overhead door, particularly intended for use in a structure having a wide opening, includes an upper section pivotally mounted by hinges to the header beam of the structure, and a taller lower section pivotally mounted to the bottom of the upper section by hinges. Guide tracks are mounted on the side door jambs of the building, and guide rollers are mounted adjacent each lateral side edge of the lower section arranged to be movably captured by the guide tracks during folding and unfolding of the door in opening and closing. A plurality of lift cables are connected at one of their ends to laterally spaced positions along the width of the lower door section and at the same height preferably above its vertical midpoint but below the point where the upper and lower sections are hinged together by a distance equal to or greater than the height of the upper section. The opposite ends of the lift cables are connected to a counterbalance.

1 Claim, 4 Drawing Figures

WIDE SPAN OVERHEAD DOOR

BACKGROUND OF THE INVENTION

This invention relates to overhead doors, and more particularly to cable drawn overhead doors having upper and lower sections arranged to be folded, one section upon the other during operation of the door between open and closed positions.

Sectioned overhead doors for use with aircraft hangers, warehouses and the like, all requiring particularly large openings, have been provided heretofore. However, such doors are characterized by structures which require that the door be supported against outward pivotal movement in open positions by heavy duty door rollers on the door and heavy duty guide tracks mounted to a building's strengthened door jambs. With the weight of these doors commonly being ½ to 1 ton or more, the supporting side structures and door guide assemblies require great strength, as the doors are arranged to bear their weight against the side tracks.

Particularly wherein structures involve unusually wide openings, such as aircraft hangers and the like, the door panels themselves must be made of strengthened materials in order to avoid sagging of the unsupported middle of the door in open position. Inexpensive light duty materials and mechanisms have heretofore been unsuitable for use in wide overhead doors for this reason, just as light duty door jamb structures are unsuitable to support strenghtened doors having great weights.

Exemplary of such prior art overhead doors are those disclosed in U.S. Pat. Nos. 1,709,872 and 1,588,663.

SUMMARY OF THE INVENTION

In its basic concept, this invention provides an overhead door having upper and lower hinged sections arranged to be collapsed one on the other to an open position in which the door sections are essentially balanced on a vertically extending guide track on each side door jamb of a building being served by the door, the lower door section mounting at intervals along its length, one end of a plurality of vertically extending lift cables which are attached at their opposite ends to a counterweight.

It is by virtue of the foregoing basic concept that the principal objective of this invention is achieved; namely, the provision of an overhead folding door which, by virtue of its novel construction and operation, overcomes the disadvantages and limitations of the prior art overhead folding doors.

Another object of this invention is the provision of an overhead door of the class described which may be made of standard or light duty door stock and support assemblies.

Another object of this invention is the provision of an overhead door of the class described which may be of any desired width and height, since the door sections are prevented from sagging in the middle when in open position.

A further object of this invention is the provision of an overhead door of the class described which is arranged to be manually operable despite its large dimensions.

A still further object of this invention is the provision of an overhead door of the class described which is of simplified construction for economical manufacture, operation and maintenance.

The foregoing and other objects and advantages of this invention will appear from the following detailed description, taken in connection with the accompanying drawings of a preferred embodiment.

BRIEF ESCRIPTION OF THE DRAWINGS

DESCRIPTION OF THE PREFERRED EMBODIMENT

The overhead door of this invention includes an upper door section 10 mounted by hinges 12 to a header beam 14 of a building structure served by the door. The hinges 12 are arranged along the longitudinal top edge of the upper section 10, to pivot the section inwardly and upwardly to a substantially horizontal position relative to the opening of the structure.

Figure 2:
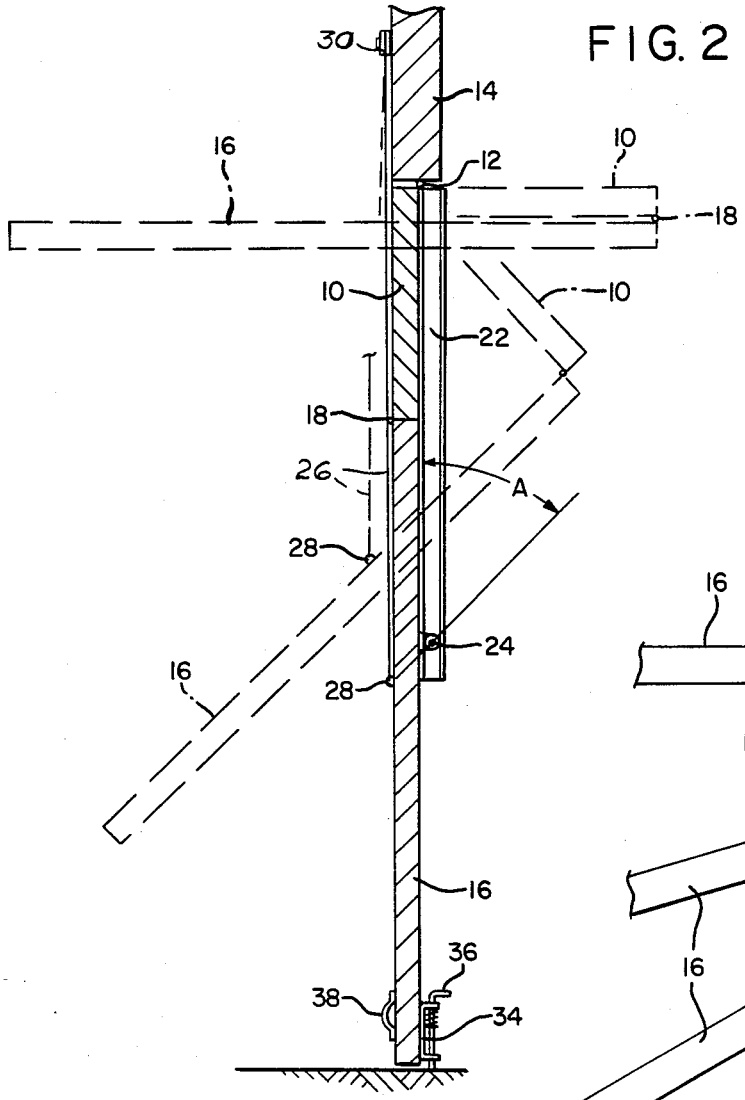
FIG. 2 is a fragmentary vertical section of the door illustrated in FIG. 1, the closed position of the door shown in solid lines and successive partly and fully open positions shown in broken lines.
Figure 4:
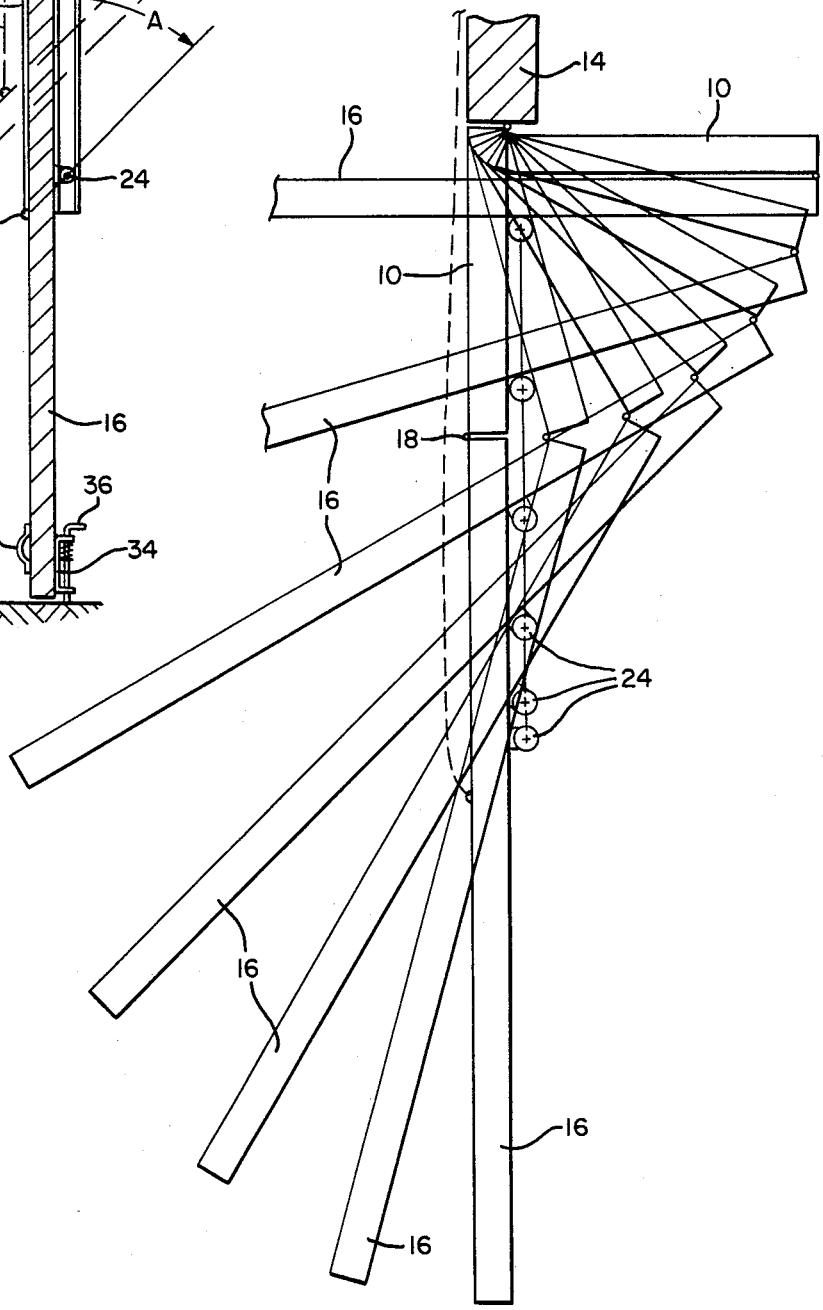
FIG. 4 is a fragmentary end elevation in schematic form of the overhead door illustrated in FIG. 1 in various positions during opening and closing of the door.

A lower door section 16, preferably proportioned between two and three times greater in height as the upper section 10, is pivotally mounted to the bottom of the upper section 10 by hinges 18. Thus, the lower section 16 is arranged to pivot upwardly and outwardly from the bottom of the upper section 10 to a substantially horizontal position under the upper section 10 when the two sections are folded into full open position, as shown in FIGS. 2 and 4.

The building structure mounts, along each of its side door jambs 20, a vertically extending guide track 22. The guide tracks are preferably configured as elongated C-shaped channels, and are mounted by conventional means to the door jambs with the open end of each facing inwardly toward the door opening.

The lower door section 16 mounts, on or adjacent each opposite longitudinal end thereof, an outwardly projecting guide roller 24 arranged to be movably captured inside the vertically extending guide track 22 associated with the respective side door jamb 20. The guide rollers are mounted on the lower door section 16 at a location described hereinafter.

Means for raising and supporting the door sections into folded condition is provided by a plurality of lift cables 26, one end of each being mounted to outside anchors 28 secured at laterally spaced intervals of equal door areas along the width of the lower door section 16. The cables are rigged vertically upward and passed over sheaves 30 and connected at their opposite ends to counterweight means illustrated generally as block 32.

Figure 1:
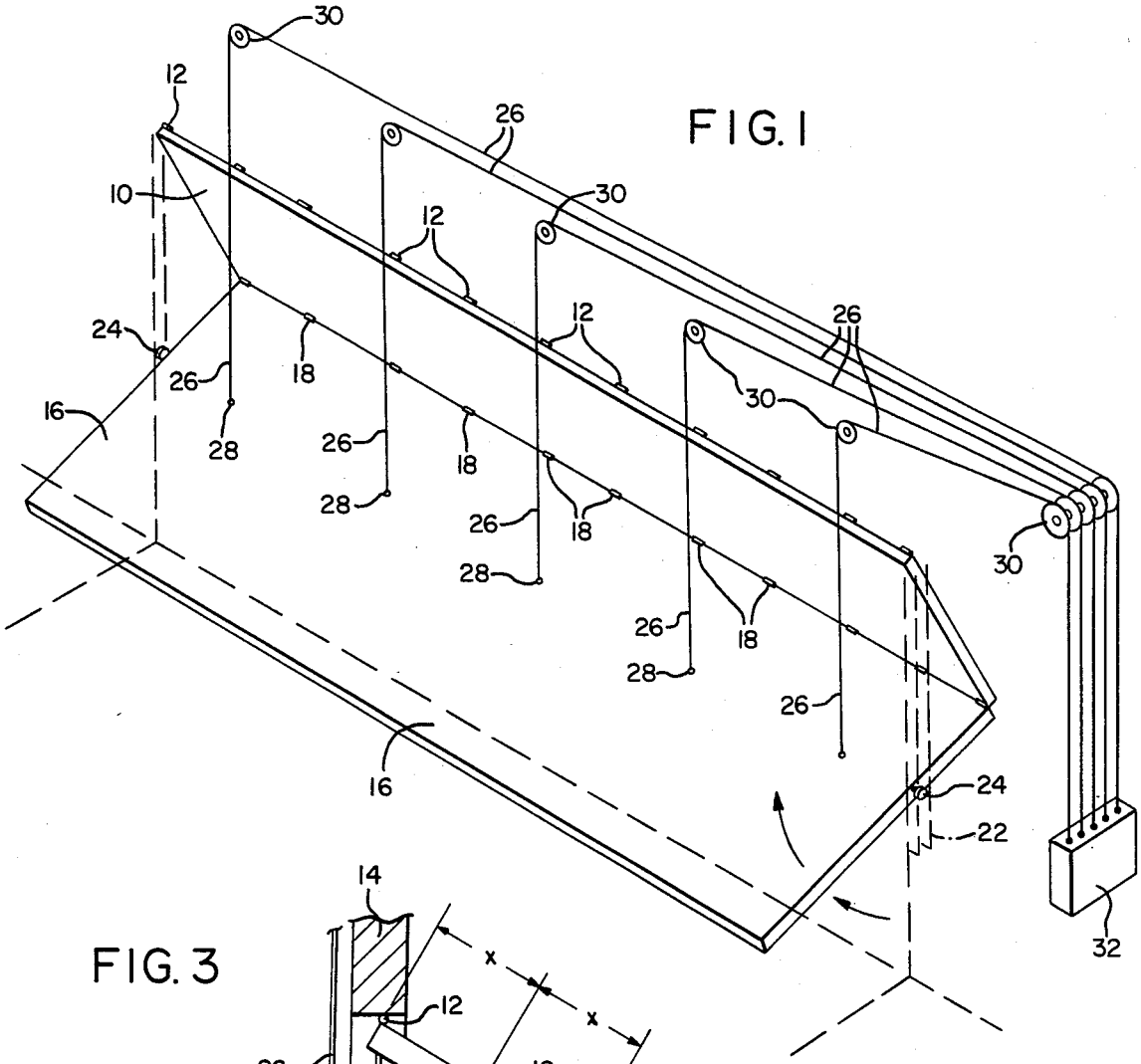
FIG. 1 is a perspective view in schematic form of an overhead door embodying the features of this invention, the door illustrated in partly open condition.
Figure 3:
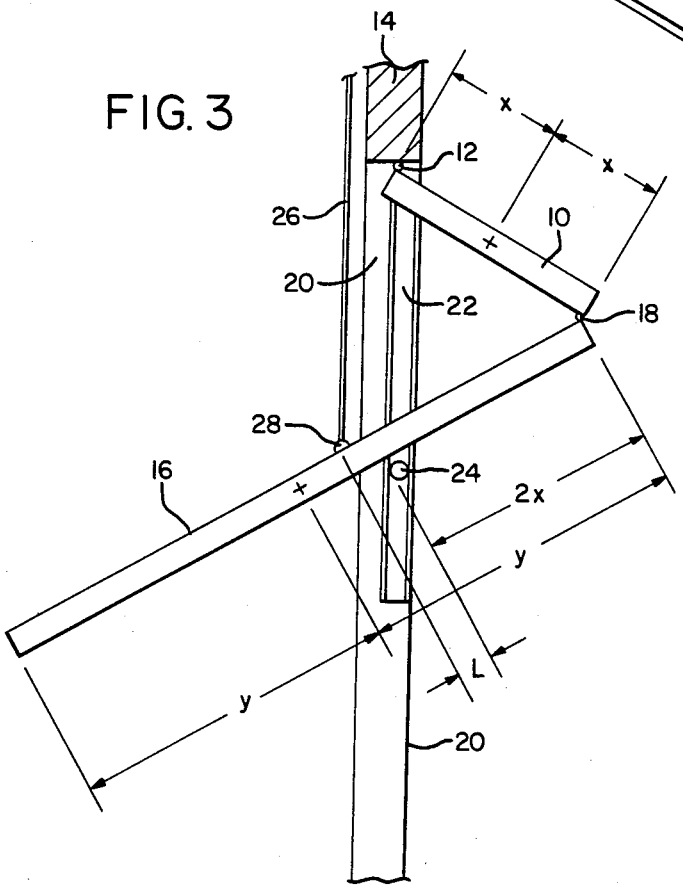
FIG. 3 is a fragmentary end elevation of the overhead door illustrated in FIG. 1, showing general dimensional relationships between parts thereof.

The cables are preferably attached to the lower door section 16 above the vertical midpoint thereof, but below the point where it is hinged to the upper section 10 by a distance equal to or greater than the height of the upper section 10. With door sections of equal cross sectional dimensions and unit weight, this point 28 of connection is the balance point for the door sections throughout the opening and closing movements. This desired cable anchor point 28 is best illustrated in FIG. 3, wherein distance y is one-half the height of the lower door section, thereby defining the vertical midpoint of that section, and distance x is one-half the height of the upper door section. 2x thus represents the height of the upper door section. L is the distance from the preferred point of cable anchorage 28 to a point on the lower door section spaced from the upper end of the lower door section by the distance 2x. Distance L is a variable which depends upon and is determined by specific door thicknesses and clearances required for cable rigging.

The preferred dimensional relationship of these components for determining the door section heights is expressed by the equation $H=2x+2y$, wherein H is the total height of the door, and for determining the optimum position for cable anchor 28 is expressed by the equation $(2x+L)x=[y-(2x+L)]2y$.

Other door section proportions and lift cable anchor points work, but are not as desirable because they allow the development of undesirable horizontal forces, front to back, on the guide rollers 24 and tracks 22.

As previously mentioned, the cables 26 are attached to the lower door section 16 preferably at regularly spaced intervals along the width thereof. In this manner, the cables are in equal tension and provide full support to the entire width of the door regardless of its dimension. Therefore, the door does not need to be made out of heavy stock material, nor does it need additional support structure to accommodate its own weight. This is particularly important in structures in which there is a great expanse between the door jambs 20. Typically, a wide span overhead door sags in the middle from its own unsupported weight when open, which eventually distorts the door to a point where it is permanently bowed. Reinforced doors having heavy support members arranged to prevent the door from sagging are extremely heavy, costly to make, and require costly heavy framing structures in the building to support them.

With as many lift cables 26 being provided as are needed to support a light duty or a heavy duty door, the problems of sagging and limited length are virtually eliminated, as are the concerns of supporting an excessively heavy door from only two widely spaced door jambs and roller tracks. Furthermore, by supporting the door sections in a substantially balanced condition over the guide tracks 22 as illustrated, the tracks 22 and rollers 24 are thus arranged specifically only to guide the door sections and not carry the weight of the door. In this manner, the door assembly does not require expensive, heavy duty guide tracks mounted on reinforced door jambs and heavy duty rollers arranged to support the weight of the door, thus considerably reducing the costs both in manufacture and maintenance.

The guide rollers 24 are mounted on the lower door section 16 preferably on a line extending rearward and upward at a 45° angle A (FIG. 2) from the cable anchor 28.

Means for locking the door against inadvertent or unauthorized opening may be provided by any of several conventional means. FIG. 2 illustrates one embodiment of an acceptable door lock for the overhead door of this invention. A bracket 34 is mounted to the inside of the lower section 16 adjacent its bottom, the bracket slidably mounting a locking bar 36 arranged for vertical movement between a raised position and a lowered position in which the bar extends downwardly beyond the bottom of the door and into a socket (not shown). Thus, when the bar is extended, the lower section 16 is prevented from outward pivotal movement, and the door cannot be opened.

Locking means such as described above offers an advantage in this particular application of an overhead door having a wide expanse. Locks that rigidly secure folding-type overhead doors do not allow the door to yield to gusts of wind against its surface, and the subsequent strain on the door may cause damage to it. The door lock described above illustrates one example of a lock that secures the lower section against outward movement, but affords a limited degree of vertical movement at the bottom edge when a wind may cause the upper and lower sections to fold slightly at the hinges 18. In this slightly folded, or buckled condition the door becomes more rigid, thus offering greater bending strength against wind loads on the door surface.

A handle member 38 may be provided to assist in manual opening of the door from the outside. Additionally, if so desired, the door may be provided with light duty conventional power means for powered operation of the door.

It is to be understood that although a typical moving weight 32 is illustrated as counterweight means for the door, other conventional counterweights may be utilized to achieve the purpose. For example, a torsion bar type counterweight, typical in the art, may be used in place of the movable weight 32, if so desired.

With the upper section 10 of the overhead door of this invention mounted pivotally to the header beam of an aircraft hanger type structure, the operation of the overhead door previously described is as follows: The door locking means is released and the lowermost portion of the door is moved outwardly and upwardly, as shown best in FIGS. 2, 3 and 4. The cables 26, by virtue of their connection to counterweight means, exert an upward pull on the lower door section to offset the weight of the total door.

As the door is moved, the sections 10 and 16 begin to pivot about their common hinges 18 and about the hinges 12 into more progressively folded positions. As the door folds, it is kept in a vertical line by the guide rollers 24 moving in their respective guide tracks 22.

As illustrated in the operational schematic drawing of FIG. 4, the door folds into positions in which the door is always substantially balanced about the cable anchors 28, with the weight of the door being supported essentially only by the hinges 12 and the lift cables 26. That is, the weight of the door is balanced evenly to opposite sides of the cable anchor 28. Thus, the guide rollers 24 function in conjunction with the guide tracks to keep the door in its appropriate operational alignment in the doorway should wind gusts be present during opening and closing, to confine the door to a stationary vertical position in the doorway when closed, and to provide guiding axis about which the door sections 16 and 10 pivot during folding.

As the lowermost portion of the door is moved outward and upward, the guide rollers begin to move, first slightly downward because of the offset of the hinges 12 and 18 due to the thickness of the door, then vertically upward in the tracks 22. The hinge connection 18 of the two sections swing inwardly and upwardly. At fully open position, illustrated in broken lines in FIG. 2, the upper section 10 is pivoted 90 degrees about hinges 12 to a horizontal position extending inwardly of the opening. The longer, lower section 16, extending in the opposite direction from its attachment to the upper section at hinges 18, projects outwardly from the opening in a horizontal disposition adjacent to and directly under section 10. The door assembly is maintained in this position by the lift provided through connection to the lower section from the cables 26 running from the counterweight 32.

Pulling downwardly on the outermost portion of section 16 draws the door downward into closed position, the door following the reverse of the opening operation described above.

It will be apparent to those skilled in the art that various changes, other than those previously described, may be made in the size, shape, type, number and arrangement of parts described herein without departing from the spirit of this invention and the scope of the appended claims.

Having thus described my invention, and the manner in which it may be used, I claim:

1. For use with a structure having an opening defined by a header beam and a pair of laterally spaced apart side door jambs, an overhead door of the folding type, comprising:

(a) a pair of door sections sized to accommodate said opening, the pair of door sections including an upper section arranged to be mounted pivotally to the header beam of the structure and a lower section mounted pivotally at its upper end to the bottom end of the upper section, the upper section being less than half the length of the lower section, (b) vertically extending guide track means mounted on each side door jamb configured to retain a guide roller therein, (c) a guide roller mounted on the lower section adjacent each side door jamb and at a distance below the upper end of the lower section about equal to the length of the upper door section, the roller being arranged for vertical movement in and retention by said guide track means, (d) at least one lift cable connected at one end to the lower door section intermediate the longitudinal ends thereof at a point below the guide roller at which the weight of the upper and lower door sections extending in one direction from said point and the weight of the lower door section extending in the opposite direction from said point are substantially balanced, the lift cable being connected to the lower door section at a point determined by the equation $(2x+L)x=[y-(2x+L)]2y$, wherein x is one half the height of the upper door section, y is one half the height of the lower door section, and L is the distance from the said connection point to a point on the lower door section spaced from the upper end of the lower door section by the distance 2x, and the total height of the door is determined by the equation $H=2x+2y$, the cable means extending vertically upward beyond the upper door section, and (e) counterweight means connected to the other end of each said lift cable and arranged to substantially counterbalance the weight of the door.

* * * * *